US008974040B2

(12) United States Patent
Kamito et al.

(10) Patent No.: US 8,974,040 B2
(45) Date of Patent: Mar. 10, 2015

(54) LIQUID DROPLET EJECTION HEAD, IMAGE FORMING APPARATUS INCLUDING SAME, AND METHOD FOR CLEANING SAME

(75) Inventors: Takao Kamito, Tokyo (JP); Hiroya Ishida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 209 days.

(21) Appl. No.: 13/312,104

(22) Filed: Dec. 6, 2011

(65) Prior Publication Data

US 2012/0154483 A1 Jun. 21, 2012

(30) Foreign Application Priority Data

Dec. 17, 2010 (JP) ..... 2010-281266
May 6, 2011 (JP) ..... 2011-103633

(51) Int. Cl.
*B41J 2/165* (2006.01)
*B41J 2/14* (2006.01)

(52) U.S. Cl.
CPC .... *B41J 2/14274* (2013.01); *B41J 2002/14403* (2013.01)
USPC ..... 347/67

(58) Field of Classification Search
None
See application file for complete search history.

(56) References Cited

U.S. PATENT DOCUMENTS

| | | | | |
|---|---|---|---|---|
| 6,213,594 | B1 * | 4/2001 | Kitahara | 347/70 |
| 6,270,191 | B1 * | 8/2001 | Morikoshi et al. | 347/44 |
| 7,658,477 | B2 | 2/2010 | Kamito | |
| 2011/0057992 | A1 * | 3/2011 | Tobita et al. | 347/54 |

FOREIGN PATENT DOCUMENTS

| | | |
|---|---|---|
| JP | 6-255101 | 9/1994 |
| JP | 2005-131791 | 5/2005 |
| JP | 2006-76111 | 3/2006 |
| JP | 2006-231812 | 9/2006 |
| JP | 2007-203512 | 8/2007 |
| JP | 2008-213196 | 9/2008 |
| JP | 2006-168249 | 6/2009 |
| JP | 2010-105261 | 5/2010 |

* cited by examiner

*Primary Examiner* — Alejandro Valencia
(74) *Attorney, Agent, or Firm* — Cooper & Dunham LLP

(57) ABSTRACT

A liquid droplet ejection head including a common liquid chamber, multiple individual liquid chambers communicating with the common liquid chamber, to which a liquid is supplied via the common liquid chamber, a nozzle plate containing multiple nozzles communicating with the multiple individual liquid chambers to eject the liquid, a filter disposed within a passageway between the common liquid chamber and the multiple individual liquid chambers to remove foreign substances from the liquid, and a through-hole provided adjacent to the filter to communicate with the multiple individual liquid chambers, and sealed by a frame member in which the common liquid chamber is formed.

7 Claims, 12 Drawing Sheets

LIQUID DROPLET EJECTION HEAD, IMAGE FORMING APPARATUS INCLUDING SAME, AND METHOD FOR CLEANING SAME

CROSS-REFERENCE TO RELATED APPLICATIONS

The present patent application is based on and claims priority pursuant to 35 U.S.C. §119 from Japanese Patent Application Nos. 2010-281266, filed on Dec. 17, 2010, and 2011-103633, filed on May 6, 2011, both in the Japan Patent Office, each of which is incorporated by reference herein in its entirety.

BACKGROUND OF THE INVENTION

1. Field of the Invention

This invention relates generally to a liquid droplet ejection head provided with a filter to remove foreign substances from the liquid, an image forming apparatus including the liquid droplet ejection head, and a method for cleaning the liquid droplet ejection head.

2. Description of the Background Art

In general, a liquid droplet ejection head such as an inkjet head employed in an inkjet-type image forming apparatus includes liquid chambers and multiple nozzles each having a diameter of 10 μm. In the inkjet-type image forming apparatus, foreign substances that inadvertently enter the inkjet head during manufacture or with a liquid such as ink dispensed from an ink cartridge to the inkjet head can cause clogging of the nozzles and irregular ejection of ink droplets from the nozzles, thereby degrading image quality. At the same time, recent improvements in processing performance of such as personal computers and other information processing devices have increased demand for high-speed inkjet-type image forming apparatuses. One way to attain high speed is increasing the number of nozzles provided to the inkjet head. However, an increase in the number of nozzles also requires an improved cleaning unit that removes foreign substances from the ink to provide reliable ejection of ink droplets from the nozzles.

There is known a type of inkjet-type image forming apparatus in which a filter that removes foreign substances and bubbles from ink is provided to a common liquid chamber through which the ink is supplied from an ink cartridge to the nozzles to prevent the nozzles from being clogged. In addition, a cleaning opening from which the foreign substances are discharged is provided downstream from the filter in a direction of flow of the ink.

It is known that the clogged nozzles tend to be found at edges of the inkjet head, as evidenced by the graph shown in FIG. 1. Further, it is known that the foreign substances found at the edges of the inkjet head come from a portion of the inkjet head provided upstream from individual liquid chambers.

The upstream portion of the inkjet head has a three-dimensionally asymmetrical shape that causes stagnation of cleaning liquid during cleaning of the inkjet head. It has been found from fluid simulation results that the inkjet head is filled with the ink from the edges to the center during ejection of ink droplets from the nozzles in the event of irregular cleaning of the upstream portion of the inkjet head. Consequently, foreign substances tend to flow to the edges of the inkjet head, yielding the same results obtained from the past production experiments described above. However, because the cleaning opening is provided to the common liquid chamber in the related-art image forming apparatus, it is difficult to reliably clean inside the inkjet head.

Thus, it is required to provide the cleaning opening to each of the individual liquid chambers in place of the common liquid chamber. However, although providing the filter to the individual liquid chambers is well known, foreign substances are trapped within the individual liquid chambers in such a configuration, thereby possibly reducing yield.

SUMMARY

In view of the foregoing, illustrative embodiments of the present invention provide a novel liquid droplet ejection head in which both a filter and a liquid discharge opening are provided to individual liquid chambers to reliably clean the minimum necessary cleaning range of the liquid droplet ejection head without decreasing yield. The illustrative embodiments also provide an inkjet-type image forming apparatus including the liquid droplet ejection head, and a method for cleaning the liquid droplet ejection head.

In one illustrative embodiment, a liquid droplet ejection head includes a common liquid chamber, multiple individual liquid chambers communicating with the common liquid chamber, to which a liquid is supplied via the common liquid chamber, a nozzle plate containing multiple nozzles communicating with the multiple individual liquid chambers to eject the liquid, a filter disposed within a passageway between the common liquid chamber and the multiple individual liquid chambers to remove foreign substances from the liquid, and a through-hole provided adjacent to the filter to communicate with the multiple individual liquid chambers, and sealed by a frame member in which the common liquid chamber is formed.

In another illustrative embodiment, an image forming apparatus to eject liquid droplets from nozzles using drive energy generated by an actuator driven based on an image signal to form an image on a recording medium includes at least the one liquid droplet ejection head described above.

In yet another illustrative embodiment, a method for cleaning the liquid droplet ejection head described above includes the steps of flowing a cleaning liquid poured from the multiple nozzles in a direction opposite a direction of flow of the liquid, discharging the cleaning liquid via the through-hole, and sealing the through-hole by the frame member after the discharging step.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
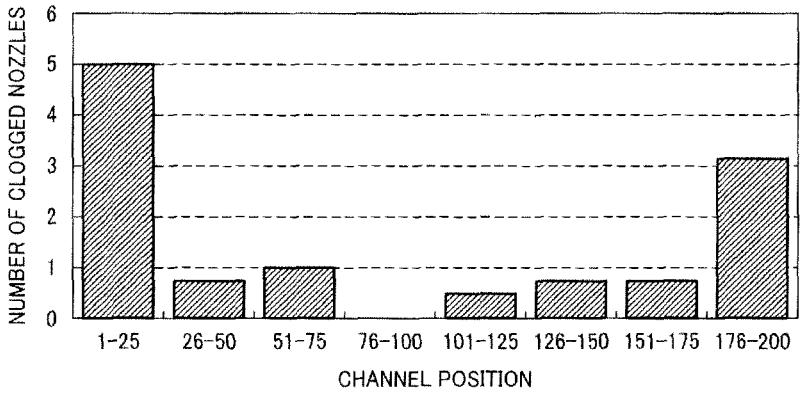
FIG. 1 RELATED ART
FIG. 1 is a graph showing a relation between number of nozzles clogged with foreign substances and channel positions in a related-art inkjet head.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Figure 2:
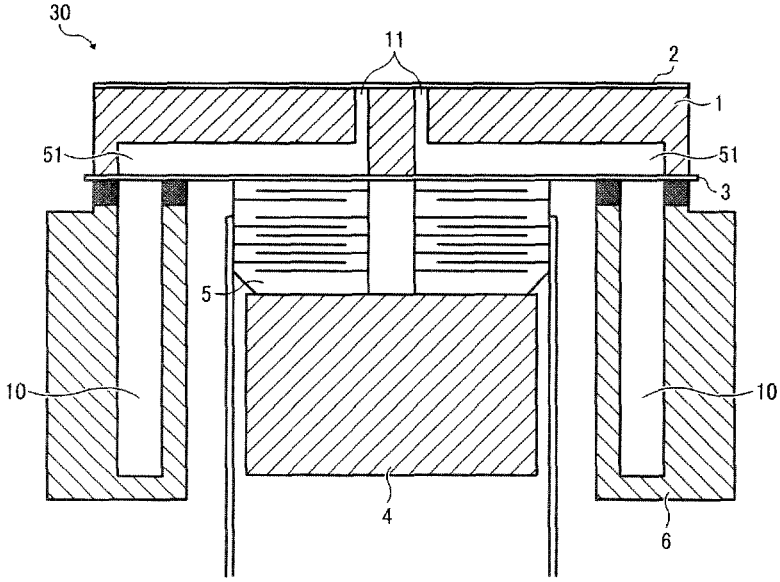
FIG. 2 is a vertical cross-sectional view illustrating an example of a configuration of a liquid droplet ejection head according to illustrative embodiments.
Figure 3:
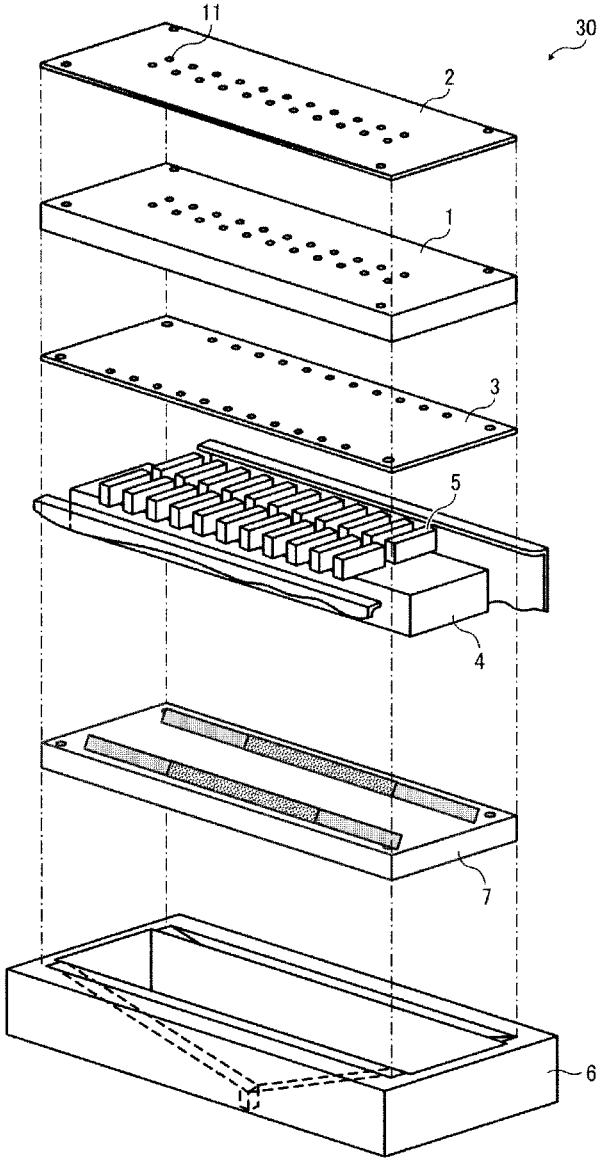
FIG. 3 is an exploded perspective view illustrating the configuration of the liquid droplet ejection head illustrated in FIG. 1.

A configuration of a liquid droplet ejection head 30 according to illustrative embodiments is described in detail below with reference to FIGS. 2 and 3. FIG. 2 is a vertical cross-sectional view illustrating an example of a configuration of the liquid droplet ejection head 30. FIG. 3 is an exploded perspective view illustrating the configuration of the liquid droplet ejection head 30 illustrated in FIG. 2.

The liquid droplet ejection head 30 includes a channel plate 1 constructed of a silicon substrate in which multiple holes and individual liquid chambers 51 each serving as a liquid channel are formed. A nozzle plate 2 having multiple nozzles 11 formed by nickel electroforming or the like is joined to an upper surface of the channel plate 1. A vibration plate 3 formed by nickel electroforming or the like is joined to a lower surface of the channel plate 1. An actuator in which two rows of laminate-type piezoelectric elements 5 are provided on a metal base member 4 is joined to a lower surface of the vibration plate 3. Further, a frame member 6 in which a common liquid chamber 10 is formed is joined to the vibration plate 3 so that a liquid such as ink is supplied to each of the individual liquid chambers 51 from the common liquid chamber 10.

In the liquid droplet ejection head 30 having the above-described configuration, application of a drive voltage to the piezoelectric elements 5 displaces the piezoelectric elements 5 in a direction of lamination, that is, a vertical direction in FIG. 3, so that the vibration plate 3 is deformed and displaced toward the individual liquid chambers 51 to reduce a volume of each of the individual liquid chambers 51. As a result, pressure in each of the individual liquid chambers 51 is increased to eject ink droplets from the nozzles 11 formed in the nozzle plate 2.

Figures 4A, 4B:
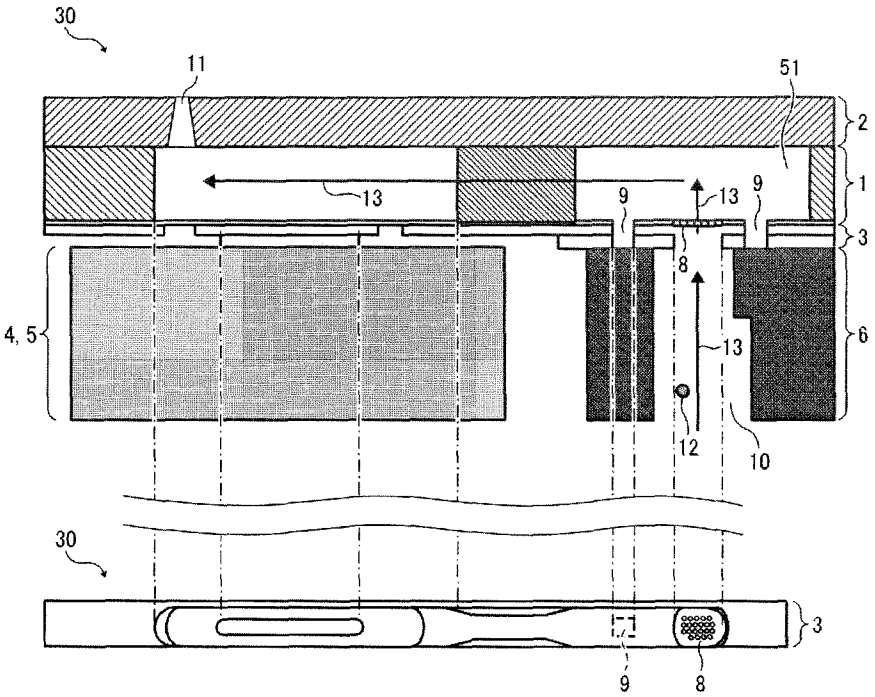
FIG. 4A is a vertical cross-sectional view illustrating an example of a configuration of a liquid droplet ejection head according to a first illustrative embodiment.
FIG. 4B is a partial plan view illustrating an example of a configuration of a vibration plate provided to the liquid droplet ejection head illustrated in FIG. 4A.
Figure 5:
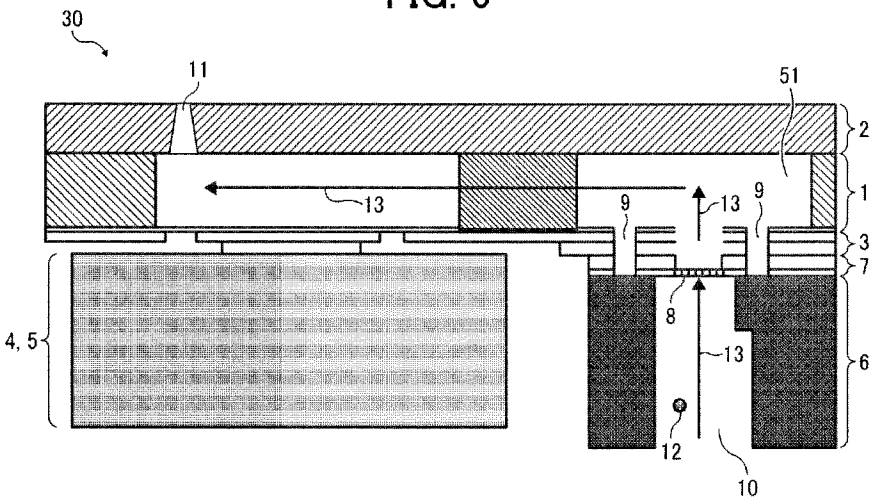
FIG. 5 is a vertical cross-sectional view illustrating an example of a configuration of a liquid droplet ejection head according to a second illustrative embodiment.
Figure 6A:
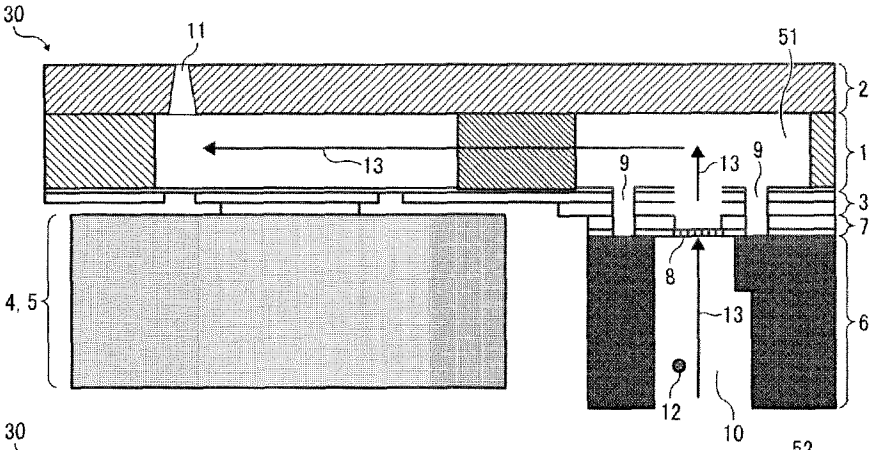
FIG. 6A is a vertical cross-sectional view illustrating an example of a configuration of a liquid droplet ejection head according to a third illustrative embodiment.
Figure 6B:
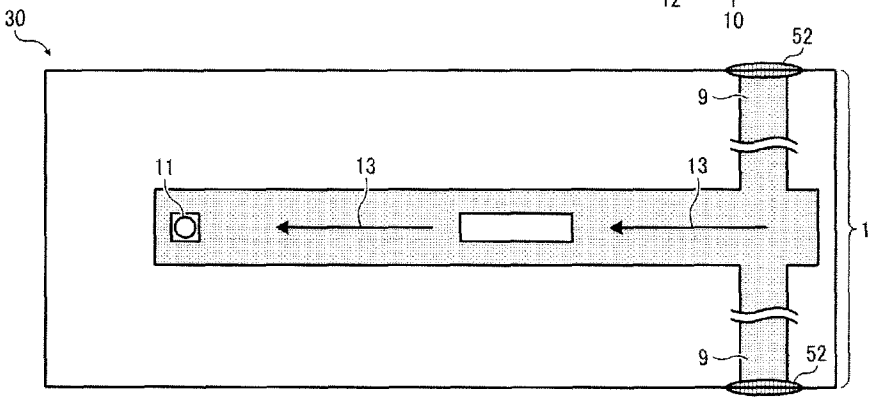
FIG. 6B is a plan view illustrating the configuration of the liquid droplet ejection head illustrated in FIG. 6A.

The configuration of the liquid droplet ejection head 30 is described in more detail with reference to FIGS. 4, 5, and 6. FIG. 4A is a vertical cross-sectional view illustrating an example of a configuration of the liquid droplet ejection head 30 according to a first illustrative embodiment, and FIG. 4B is a partial plan view illustrating an example of a configuration of the vibration plate 3 provided to the liquid droplet ejection head 30 illustrated in FIG. 4A. FIG. 5 is a vertical cross-sectional view illustrating an example of a configuration of the liquid droplet ejection head 30 according to a second illustrative embodiment. FIG. 6A is a vertical cross-sectional view illustrating an example of a configuration of the liquid droplet ejection head 30 according to a third illustrative embodiment, and FIG. 6B is a plan view illustrating the configuration of the liquid droplet ejection head 30 illustrated in FIG. 6A.

In the first illustrative embodiment illustrated in FIGS. 4A and 4B, a filter 8 and through-holes serving as cleaning liquid discharge openings 9 are provided to the vibration plate 3. The cleaning liquid discharge openings 9 are sealed with the frame 6 upon formation of the common liquid chamber 10. The filter 8 catches foreign substances 12 which are, for example, inadvertently contained in an ink cartridge and flow together with the ink in a direction indicated by arrows 13 in FIG. 4A, at the common liquid chamber 10. It is to be noted that the filter 8 may be formed together with the vibration plate 3 as a single integrated member.

In the second illustrative embodiment illustrated in FIG. 5, the filter 8 is provided to a channel formation plate 7 shown also in FIG. 3, whereas the cleaning liquid discharge openings 9 are provided to both the vibration plate 3 and the channel formation plate 7. Only the cleaning liquid discharge openings 9 provided to the channel formation plate 7 are sealed with the frame 6 upon formation of the common liquid chamber 10. The filter 8 catches the foreign substances 12 at the common liquid chamber 10. It is to be noted that the filter 8 may be formed together with the channel formation plate 7 as a single integrated member.

Although the cleaning liquid discharge openings 9 are provided to both right and left sides of the filter 8 in the first and second illustrative embodiments as illustrated in FIGS. 4A and 5, respectively, alternatively only a single cleaning liquid discharge opening 9 may be provided to the right or left side of the filter 8.

In the third illustrative embodiment illustrated in FIGS. 6A and 6B, the filter 8 is provided to the channel formation plate 7 and the cleaning liquid discharge openings 9 are provided to the channel plate 1. The cleaning liquid discharge openings 9 are sealed with an adhesive 52 upon formation of the common liquid chamber 10. The filter 8 catches the foreign substances 12 at the common liquid chamber 10. It is to be noted that the filter 8 may be formed together with the channel formation plate 7 as a single integrated member. Alternatively, the filter 8 may be provided to the vibration plate 3 in a manner similar to the configuration of the first illustrative embodiment illustrated in FIGS. 4A and 4B and be formed together with the vibration plate 3 as a single integrated member.

Although the cleaning liquid discharge openings 9 are provided to both edges of the channel plate 1 as illustrated in FIG. 6B, alternatively only the single liquid discharge opening 9 may be provided to one of the edges of the channel plate 1.

Figure 8B:
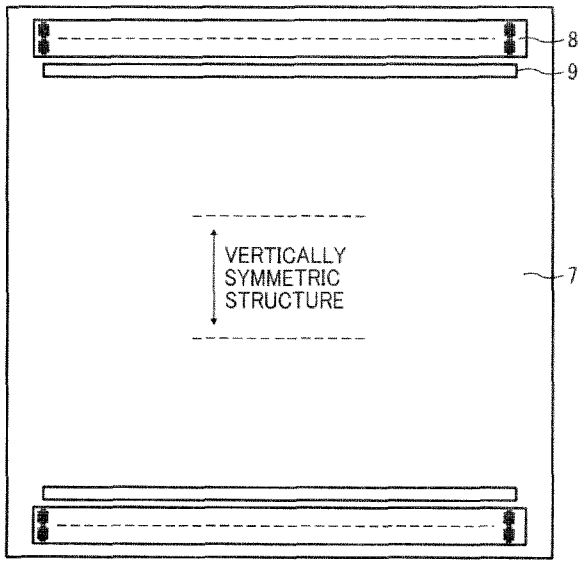
FIG. 8B is a plan view illustrating another example of a configuration of the channel formation plate.
Figure 8A:
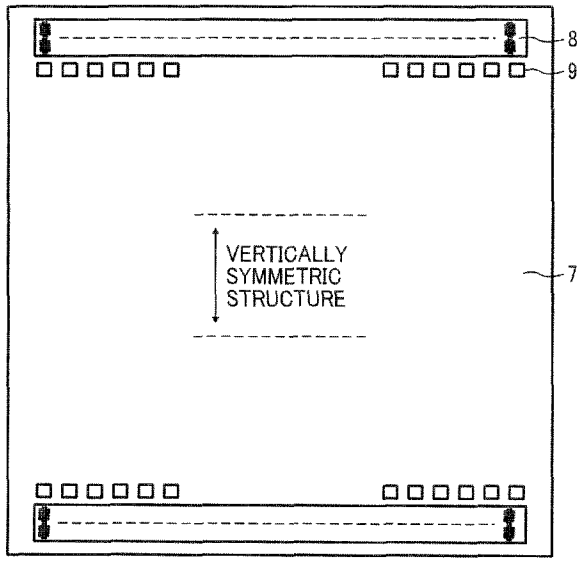
FIG. 8A is a plan view illustrating an example of a configuration of a channel formation plate provided to the liquid droplet ejection head according to the second illustrative embodiment.

In the first illustrative embodiment, the filter 8 is provided relatively close to the nozzles 11. Consequently, fluid resistance of the filter 8 may cause irregular ejection of the ink droplets from the nozzles 11. By contrast, in the second illustrative embodiment, the filter 8 is provided upstream and closer to the common liquid chamber 10 compared to the first illustrative embodiment, thereby preventing irregular ejection of the ink droplets from the nozzles 11 caused by fluid resistance of the filter 8. It is to be noted that, in the second illustrative embodiment, irregular ejection of the ink droplets can be prevented by increasing a size of the filter 8 as illustrated in FIGS. 8A and 8B in the event of large fluid resistance of the filter 8.

Figure 7B:
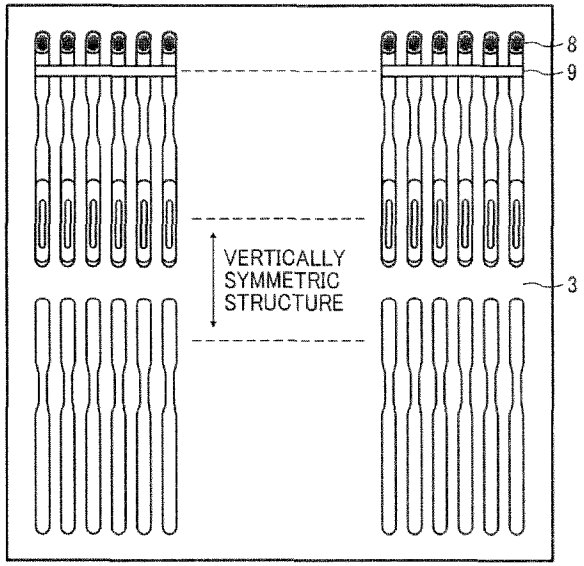
FIG. 7B is a plan view illustrating another example of a configuration of the vibration plate.
Figure 7A:
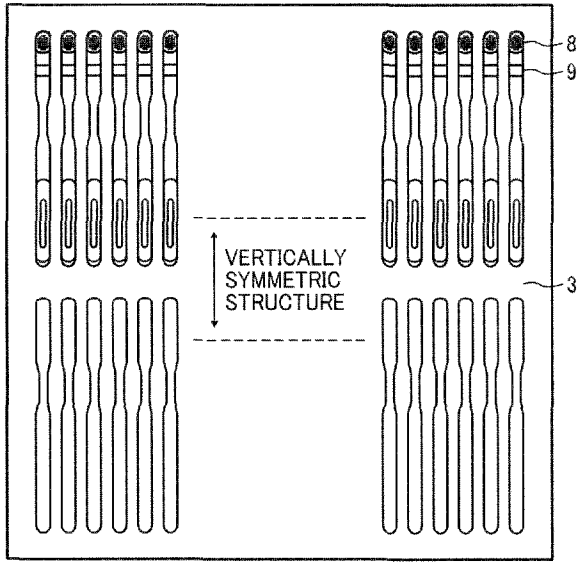
FIG. 7A is a plan view illustrating an example of a configuration of the vibration plate provided to the liquid droplet ejection head according to the first illustrative embodiment.
Figure 9:
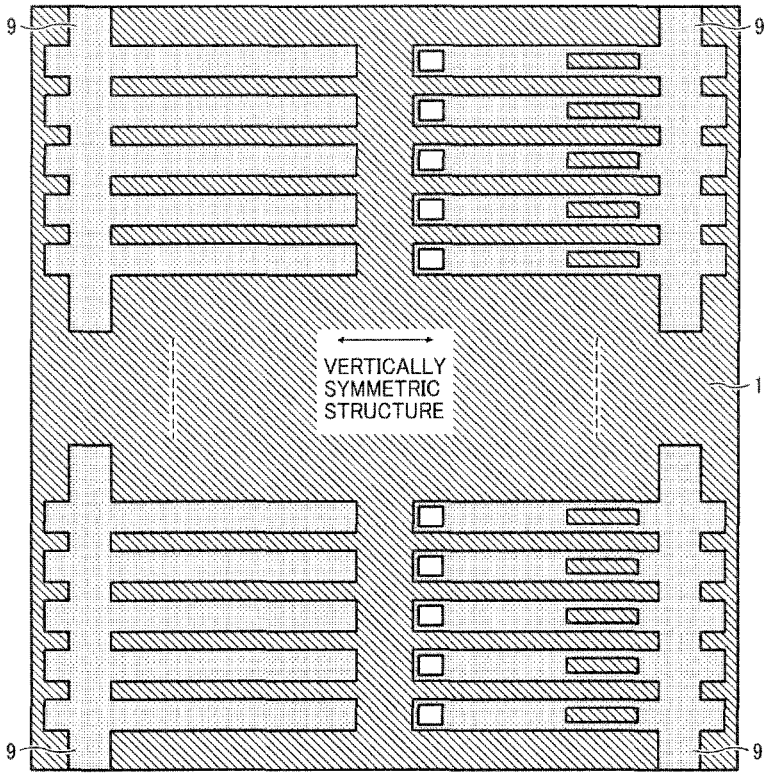
FIG. 9 is a plan view illustrating an example of a configuration of a channel plate provided to the liquid droplet ejection head according to the third illustrative embodiment.

FIG. 7A is a plan view illustrating an example of a configuration of the vibration plate 3 provided to the liquid droplet ejection head 30 according to the first illustrative embodiment in which the common liquid chamber 10 directly communicates with each of the individual liquid chambers 51 via the filter 8. In other words, portions downstream from the filter 8 do not communicate with one another in the configuration illustrated in FIG. 7A. FIG. 7B is a plan view illustrating an example of a configuration of the vibration plate 3 provided to the liquid droplet ejection head 30 according to the first illustrative embodiment in which all the individual liquid chambers 51 provided downstream from the filter 8 communicate with one another via the cleaning liquid discharge openings 9. In other words, a second common liquid chamber is formed downstream from the filter 8 in the configuration illustrated in FIG. 7B. FIG. 8A is a plan view illustrating an example of a configuration of the channel formation plate 7 provided to the liquid droplet ejection head 30 according to the second illustrative embodiment in which the common liquid chamber 10 directly communicates with each of the individual liquid chambers 51 via the filter 8. FIG. 8B is a plan view illustrating an example of a configuration of the channel formation plate 7 provided to the liquid droplet ejection head 30 according to the second illustrative embodiment in which all the individual liquid chambers 51 provided downstream from the filter 8 communicates with one another via the cleaning liquid discharge openings 9. FIG. 9 is a plan view illustrating an example of a configuration of the channel plate 1 provided to the liquid droplet ejection head 30 according the third illustrative embodiment.

It is preferable that the filter 8 be the first layer of an electroform film having a thickness of not greater than 5 μm, more preferably about 3 μm. Because an increase in the thickness of the electroform film increases the fluid resistance of the film 8 and prevents regular ejection of the ink droplets, the first layer of the electroform film is preferably used for the filter 8.

In the foregoing illustrative embodiments, a size of each of openings formed in the filter 8 is smaller than a size of each of the nozzles 11. Therefore, the foreign substances 12 do not reach the nozzles 11, and the ink droplets are reliably ejected from the nozzles 11. In addition, because the filter 8 is provided close to the nozzles 11, a range to be cleaned with a cleaning liquid described in detail later can be limited to only the individual liquid chambers 51 upon removal of foreign substances from the liquid droplet ejection head 30, thereby facilitating cleaning of the liquid droplet ejection head 30.

Further, in the foregoing illustrative embodiments, a size of each of the cleaning liquid discharge openings 9 is larger than a size of each of the nozzles 11.

Figure 10:
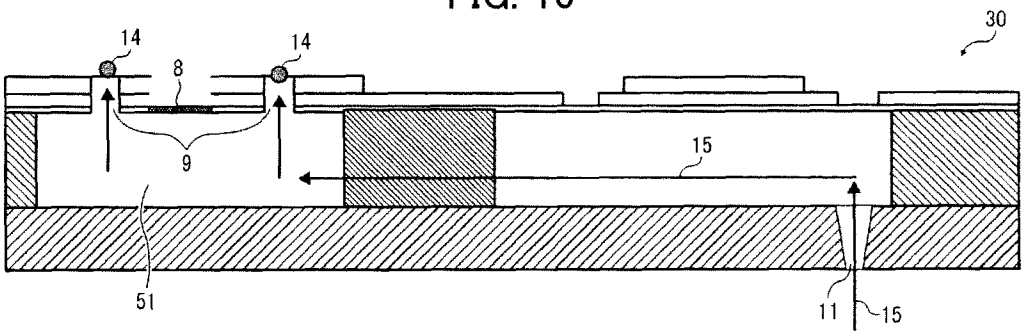
FIG. 10 is a vertical cross-sectional view describing cleaning of individual liquid chambers provided to the liquid droplet ejection head according to the first illustrative embodiment.
Figure 11:
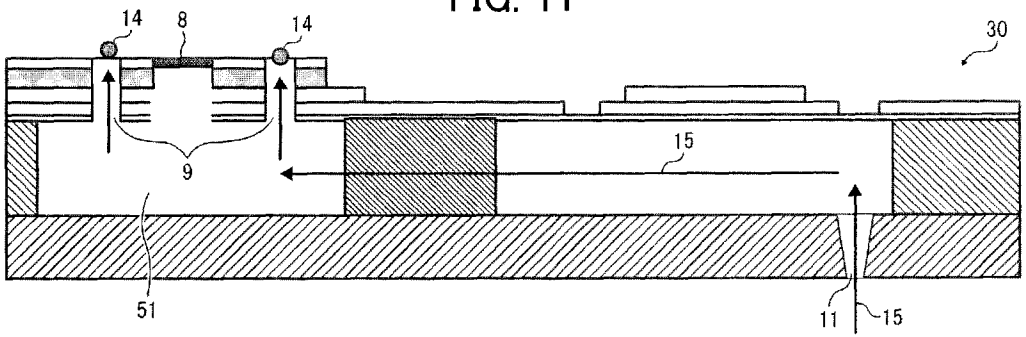
FIG. 11 is a vertical cross-sectional view describing cleaning of individual liquid chambers provided to the liquid droplet ejection head according to the second illustrative embodiment.
Figure 12A:
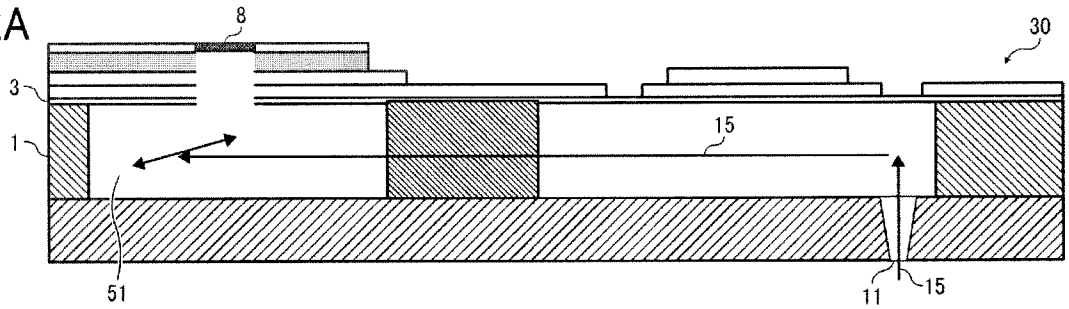
FIG. 12A is a vertical cross-sectional view describing cleaning of individual liquid chambers provided to the liquid droplet ejection head according to the third illustrative embodiment.
Figure 12B:
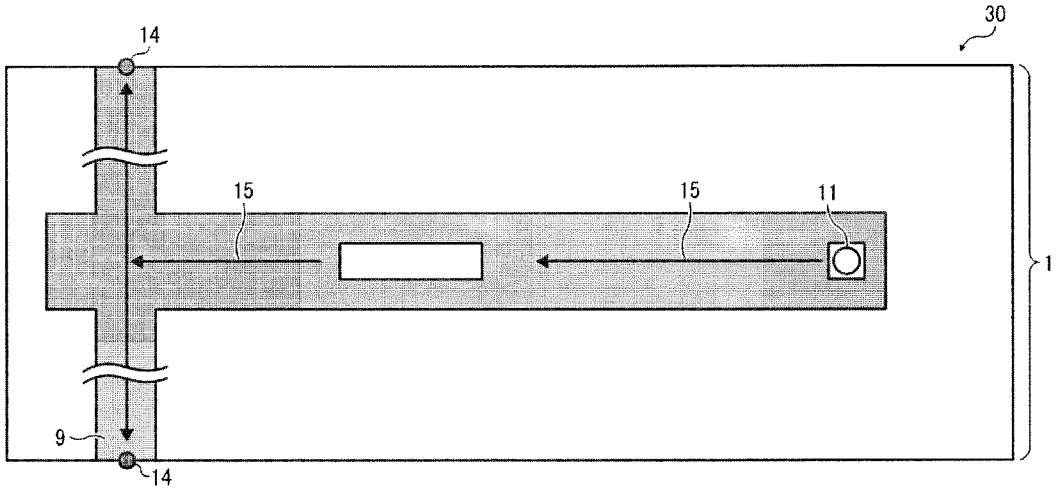
FIG. 12B is a plan view illustrating the configuration of the liquid droplet ejection head illustrated in FIG. 12A.

A description is now given of removal of foreign substances 14 that might be inadvertently contained in the individual liquid chambers 51 during manufacture from the liquid droplet ejection head 30 with reference to FIGS. 10, 11, and 12. FIG. 10 is a vertical cross-sectional view describing cleaning of the individual liquid chambers 51 provided to the liquid droplet ejection head 30 according to the first illustrative embodiment. FIG. 11 is a vertical cross-sectional view describing cleaning of the individual liquid chambers 51 provided to the liquid droplet ejection head 30 according to the second illustrative embodiment. FIG. 12A is a vertical cross-sectional view describing cleaning of the individual liquid chambers 51 provided to the liquid droplet ejection head 30 according to the third illustrative embodiment. FIG. 12B is a plan view describing cleaning of the individual liquid chambers 51 illustrated in FIG. 12A.

A cleaning liquid such as acetone or ethanol is poured from the nozzles 11 so that the cleaning liquid flows as indicated by arrows 15 through the individual liquid chambers 51 in a direction opposite the direction of flow of ink shown in FIGS. 4, 5, and 6, and is discharged from the cleaning liquid discharge openings 9. As a result, the foreign substances 14 inadvertently contained in the individual liquid chambers 51 are discharged from the cleaning liquid discharge openings 9 together with the cleaning liquid.

However, the foreign substances 14 may be caught by the filter 8 without being discharged from the cleaning liquid discharge openings 9 during cleaning of the individual liquid chambers 51. In order to solve such a problem, first, the filter 8 and the cleaning liquid discharge openings 9 are filled with the cleaning liquid, and then the cleaning liquid flows as indicated by the arrows 15 in FIGS. 10, 11, and 12. As a result, the flow of cleaning liquid can be controlled near the filter 8, thereby preventing the foreign substances 14 from being caught by the filter 8.

After being cleaned with the cleaning liquid, the liquid discharge openings 9 are sealed with the frame 6 or the adhesive 52 so that no foreign substance is present in the individual liquid chambers 51.

An image forming apparatus employing the liquid droplet ejection head 30 according to the foregoing illustrative embodiments prevents irregular ejection of ink droplets and achieves stable image formation. In addition, stable ejection of ink droplets from the nozzles 11 can be achieved. As a result, ink droplets are simultaneously ejected from the multiple nozzles 11 to perform image formation at high speed. Configuration and operation of an image forming apparatus 21 employing the liquid droplet ejection head 30 are described in detail later.

Although the piezoelectric elements 5 are provided to the actuator of the liquid droplet ejection head 30 to generate energy to eject ink droplets from the nozzles 11 in the above-described examples, the configuration of the liquid droplet ejection head 30 is not limited thereto. Alternatively, bubbles may be generated by a heating element to eject the ink or a vibration plate that forms a wall of a liquid channel may be displaced by an electrostatic force generated between the vibration plate and an electrode provided opposite the vibration plate to eject the ink.

Figure 13:
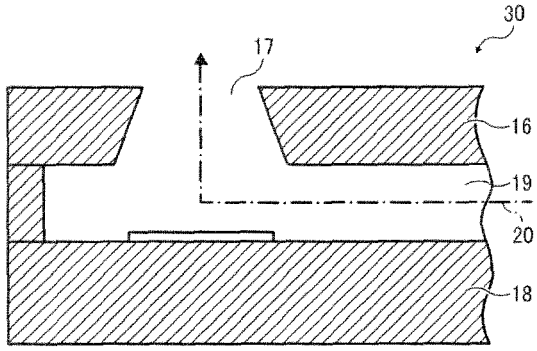
FIG. 13 is a vertical cross-sectional view illustrating an example of a configuration of a liquid droplet ejection head employing a side-shooter system.

In addition, although an edge-shooter ejection head in which the ink, to which the ejection energy is supplied from the vibration plate 3, flows in a direction along axes of the nozzles 11 is employed in the foregoing illustrative embodiments, the configuration of the liquid droplet ejection head 30 is not limited thereto. Alternatively, a side-shooter system may be employed in the liquid droplet ejection head 30. Thus, in the liquid droplet ejection head 30 employing the side-shooter system illustrated in FIG. 13, nozzles 17 are provided in a top board 16, and a channel 19 formed by the top board 16 and a channel board 18 is provided perpendicular to axes of the nozzles 17 so that the ink, to which the ejection energy is supplied, flows in a direction perpendicular to axes of the nozzles 17 as indicated by arrow 20.

Use of the side-shooter system can more efficiently convert the ejection energy generated by an ejection energy generator such as the vibration plate 3 to kinetic energy to form ink droplets. In addition, a meniscus generated at the nozzles 17 is restored rapidly by supply of the ink. Therefore, the side-shooter system is particularly effective when a heating element is used as the ejection energy generator. Further, the side-shooter system can prevent cavitation which occurs in the edge-shooter system. When cavitation occurs, an impact generated as the bubbles pop in the ink gradually destroys the ejection energy generator. In the side-shooter system, the bubbles grow larger and reach the nozzles 17 to communicate with air, thereby preventing shrinkage of the bubbles caused by a temperature decrease and extending product life of the liquid droplet ejection head 30.

In addition, application of the foregoing illustrative embodiments to a liquid channel can provide a higher-quality liquid droplet ejection head with high ejection accuracy.

Figure 14:
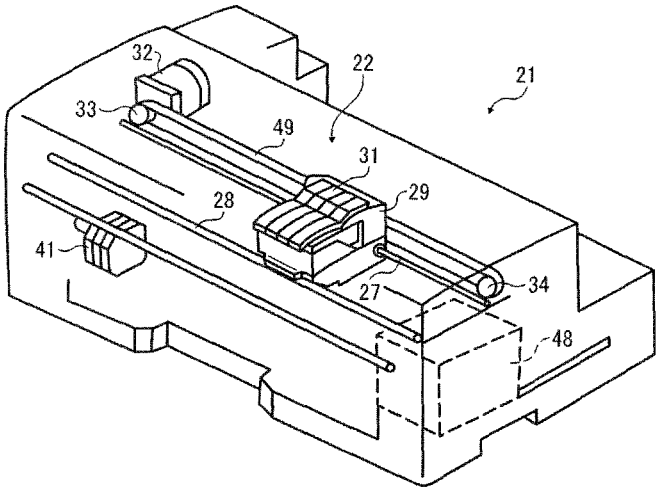
FIG. 14 is a partial perspective view illustrating an example of a configuration of an image forming apparatus employing the liquid droplet ejection head according to illustrative embodiments.
Figure 15:
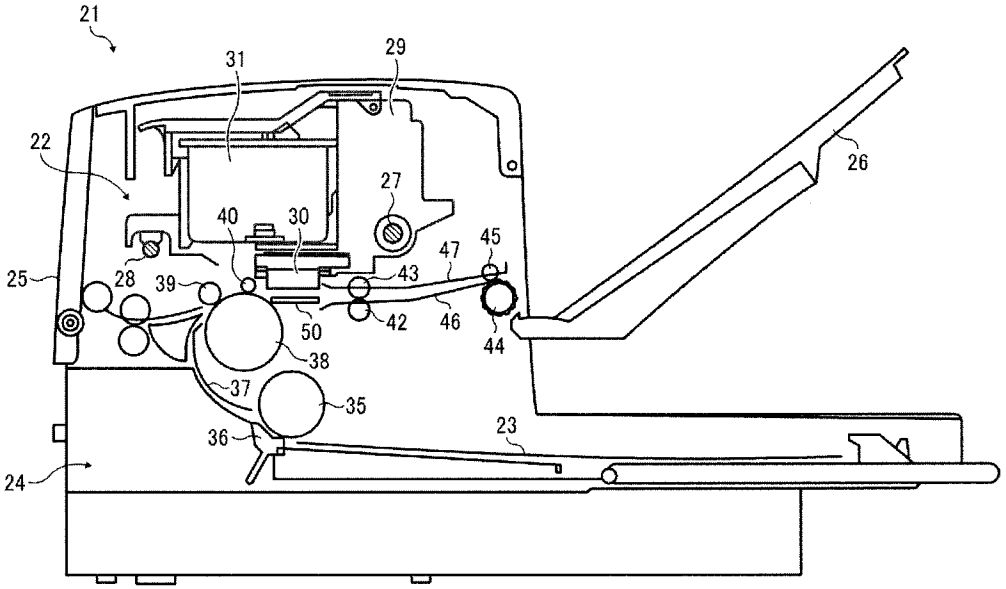
FIG. 15 is a vertical cross-sectional view illustrating the configuration of the image forming apparatus illustrated in FIG. 14.

A description is now given of a configuration of an image forming apparatus 21 according to illustrative embodiment with reference to FIGS. 14 and 15.

As describe previously, the image forming apparatus 21 employs the liquid droplet ejection head 30. FIG. 14 is a partial perspective view illustrating an example of a configuration of the image forming apparatus 21 employing the liquid droplet ejection head 30. FIG. 15 is a vertical cross-sectional view illustrating the configuration of the image forming apparatus 21 illustrated in FIG. 14.

The image forming apparatus 21 includes an image formation mechanism 22 constructed of a carriage 29 movable in a main scanning direction, the liquid droplets ejection head 30 installed in the carriage 29, an ink cartridge 31 that supplies ink to the liquid droplet ejection head 30, and so forth.

A sheet feed tray 24 capable of storing multiple sheets 23 is detachably attached to the image forming apparatus 21 from the front side of the image forming apparatus 21. The image forming apparatus 21 further includes a foldably openable manual sheet feed tray 25 from which the sheets 23 can be manually fed. The sheets 23 fed from the sheet feed tray 24 or the manual sheet feed tray 25 are conveyed to the image formation mechanism 22 to form images on the sheets 23. Thereafter, the sheets 23 having the images thereon are discharged from the image forming apparatus 21 to a discharge tray 26 provided on a back surface of the image forming apparatus 21.

In the image formation mechanism 22, the carriage 29 is slidably held and reciprocally movable in the main scanning direction, that is, a direction perpendicular to the plane of the sheet of paper on which FIG. 15 is drawn, by a main guide rod 27 and a sub-guide rod 28 each extended between right and left lateral plates of the image forming apparatus 21. The liquid droplet ejection head 30 that ejects ink droplets of specific colors, that is, yellow (Y), cyan (C), magenta (M), and black (K), is installed on the carriage 29. Multiple nozzles 11 provided to the liquid droplet ejection head 30 are arranged in a direction intersecting with the main scanning direction and the ink droplets are ejected downward from the nozzles 11. The ink cartridge 31 that supplies ink of the specified colors to the liquid droplet ejection head 30 is replaceably attached to the carriage 29.

The ink cartridge 31 has an opening that communicates with air at an upper portion thereof, a supply opening from which the ink is supplied to the liquid droplet ejection head 30 at a lower portion thereof, and a porous body filled with the ink at an inner portion thereof. The ink supplied to the liquid droplet ejection head 30 by capillary action of the porous body is controlled to have a slightly negative pressure.

Although the single liquid droplet ejection head 30 that ejects ink droplets of multiple colors is employed in the image forming apparatus 21 in the above-described example, alternatively, multiple liquid droplet ejection heads 30 corresponding to number of colors used may be provided to the image forming apparatus 21. A piezo-type ejection head in which the ink is energized by an electromechanical converter such as a piezoelectric element via a vibration plate that forms a wall of a liquid chamber, a bubble-type ejection head in which bubbles are generated by a heat resistor to pressurize the ink, or an electrostatic ejection head that displaces a vibration plate forming a wall of a liquid channel by an electrostatic force generated between the vibration plate and electrodes provided opposite the vibration plate to energize the ink, may be used as the liquid droplet ejection head 30. In illustrative embodiments, an electrostatic ejection head is used as the liquid droplet ejection head 30.

A rear end of the carriage 29 slidably engages the main guide rod 27, and a front end thereof is slidably placed on the sub-guide rod 28. The image forming apparatus 21 further includes a main scanning motor 32, a drive pulley 33 rotatively driven by the main scanning motor 32, a driven pulley 34, and a timing belt 49 extended between the drive pulley 33 and the driven pulley 34. The timing belt 49 is fixed to the carriage 29 so that the carriage 29 is moved reciprocally back and forth in the main scanning direction by normal and reverse rotations of the main scanning motor 32.

The image forming apparatus 21 further includes a sheet feed roller 35 and a friction pad 36, both of which separate the sheets 23 stored in the sheet feed tray 24 to feed the sheets 23 one by one from the sheet feed tray 24 to the liquid droplet ejection head 30, a guide member 37 that guides the sheets 23, a first conveyance roller 38 that reverses the sheets 23 to convey the sheets 23 to the liquid droplet ejection head 30, a second conveyance roller 39 pressed against the first conveyance roller 38, and a head roller 40 that sets an angle of conveyance of the sheets 23 conveyed by the conveyance roller 38. The conveyance roller 38 is rotatively driven by a sub-scanning motor 41 via a gear train.

The image forming apparatus 21 further includes a receiver 50 serving as a sheet guide member provided below the liquid droplet ejection head 30 corresponding to a scanning range of the carriage 29 in the main scanning direction to guide the sheets 23 conveyed from the first conveyance roller 38. A third conveyance roller 42 rotatively driven to convey the sheets 23 in a direction of discharge of the sheets 23, a conveyance spur 43, a discharge roller 44 that discharges the sheets 23 to the discharge tray 26, a discharge spur 45, and guide members 46 and 47 together defining a discharge passageway along which the sheets 23 travel are provided downstream from the receiver 50 in the direction of conveyance of the sheets 23.

During image formation, the image forming apparatus 21 drives the carriage 29 based on image signals so that ink droplets are ejected from the liquid droplet ejection head 30 to the sheet 23, which remains stationary, while the carriage 29 is moved to form a single line in an image to be formed on the sheet 23. Thereafter, the sheet 23 is conveyed by a predetermined amount to perform image formation of the next line. When receiving a completion signal or a signal which indicates that a trailing edge of the sheet 23 reaches an imaging range, the image forming apparatus 21 completes image formation to discharge the sheet 23 to the discharge tray 26.

A servicing device 48 that services the nozzles 11 in the liquid droplet ejection head 30 is provided outside the imaging range of the image forming apparatus 21 at one end of the main scanning direction of the carriage 29 to prevent irregular ejection of the ink droplets from the nozzles 11 of the liquid droplet ejection head 30. The servicing device 48 includes a cap, a suction unit, and a cleaning unit. The carriage 29 is moved to face the servicing device 48 during standby, and the liquid droplet ejection head 30 is capped with the cap. Accordingly, the nozzles 11 are moisturized during standby, thereby preventing irregular ejection of the ink droplets from the nozzles 11 caused by dried ink. In addition, during image formation, the liquid droplet ejection head 30 ejects ink droplets which are not used for image formation so that ink droplets to be ejected from the nozzles 11 have the same viscosity to maintain stable ejection of the ink droplets.

Upon occurrence of irregular ejection of the ink droplets, the nozzles 11 are capped with the cap and bubbles and so forth are sucked out from the nozzles 11 together with the ink by the suction unit via a tube. In addition, ink and foreign substances attaching to a surface of each of the nozzles 11 are removed by the cleaning unit to service the nozzles 11. As a result, ink droplets are reliably ejected from the nozzles 11. The ink sucked out from the nozzles 11 by the suction unit is discharged to a waste ink storage container provided at a bottom portion of the image forming apparatus 21 to be absorbed and held by an ink absorber provided within the waste ink storage container.

Thus, the minimum necessary cleaning range of the liquid droplet ejection head 30 is reliably and efficiently cleaned without decreasing yield in the image forming apparatus 21 employing the liquid droplet ejection head 30.

In the liquid droplet ejection head 30 according to the first and second illustrative embodiments, the liquid discharge openings 9 are sealed upon formation of the common liquid chamber 10 without using additional members, thereby reducing production costs.

In the liquid droplet ejection head 30 according to the foregoing illustrative embodiments, the vibration plate 3 and the filter 8 are formed together as a single integrated member so that the liquid channels can be formed at reduced costs.

In addition, the vibration plate 3 having the filter 8 is formed by electroforming Accordingly, holes are accurately provided to the filter 8 and a target fluid resistance value can be reliably obtained.

Further, the filter 8 has the same thickness as the first layer of the vibration plate 3, that is, not greater than 5 μm, thereby reducing fluid resistance of the filter 8.

In the liquid droplet ejection head 30 according to the foregoing illustrative embodiments, a size of each of the holes of the filter 8 is smaller than a size of each of the nozzles 11. As a result, the foreign substances 12 are reliably caught by the filter 8 at an upstream side in the flow of ink to achieve regular ejection of the ink droplets from the nozzles 11.

In addition, a size of each of the cleaning liquid discharge openings 9 is larger than a size of each of the nozzles 11. As a result, the foreign substances 14 inadvertently contained in the liquid droplet ejection head 30 during manufacture can be reliably removed to achieve regular ejection of the ink droplets from the nozzles 11.

As described previously, the liquid droplet ejection head 30 according to the foregoing illustrative embodiments employs the side-shooter system. Therefore, a sufficient ejection pressure to eject the ink droplets can be obtained even when the filter 8 is provided near the nozzles 11.

The image forming apparatus 21 employs the liquid droplet ejection head 30 having higher cleaning performance according to the foregoing illustrative embodiments. Accordingly, ink droplets are reliably ejected from the nozzles 11, thereby providing higher quality images.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A liquid droplet ejection head comprising:

a common liquid chamber that supplies a liquid to multiple individual liquid chambers;

the multiple individual liquid chambers communicating with the common liquid chamber via a communication hole penetrating a member that forms a wall of the multiple individual liquid chambers, wherein the liquid is supplied from the common liquid chamber to the multiple individual liquid chambers via the communication hole;

a nozzle plate containing multiple nozzles communicating with the multiple individual liquid chambers to eject the liquid;

a filter disposed within a passageway between the common liquid chamber and the multiple individual liquid chambers to remove foreign substances from the liquid;

a through-hole provided adjacent to the filter and sealed by a frame member in which the common liquid chamber is formed; and a deformable vibration plate to compress the liquid supplied to the multiple individual liquid chambers, wherein both the filter and the through-hole are disposed in the vibration plate, the through-hole penetrates the member that forms a wall of the individual liquid chambers, and an opening of the through-hole is sealed by a wall of the frame member.

2. The liquid droplet ejection head according to claim 1, wherein the through-hole is provided downstream from the filter in a direction of flow of the liquid.

3. The liquid droplet ejection head according to claim 1, wherein:

the vibration plate has a multi-layer construction; and the filter has a thickness not greater than 5 μm.

4. The liquid droplet ejection head according to claim 1, wherein a size of each of multiple openings provided to the filter is smaller than a size of each of the nozzles.

5. The liquid droplet ejection head according to claim 1, wherein a size of the through-hole is larger than a size of each of the nozzles.

6. The liquid droplet ejection head according to claim 1, further comprising a channel plate joined to a lower surface of the nozzle plate to define the multiple individual liquid chambers together with the nozzle plate having the multiple nozzles, wherein the multiple individual liquid chambers are disposed perpendicular to axes of the multiple nozzles to eject the liquid in a direction perpendicular to the axes of the multiple nozzles.

7. An image forming apparatus to eject liquid droplets from nozzles using drive energy generated by an actuator driven based on an image signal to form an image on a recording medium, the image forming apparatus comprising at least one liquid droplet ejection head comprising:

a common liquid chamber that supplies a liquid to multiple individual liquid chambers;

the multiple individual liquid chambers communicating with the common liquid chamber via a communication hole penetrating a member that forms a wall of the multiple individual liquid chambers, wherein the liquid is supplied from the common liquid chamber to the multiple individual liquid chambers via the communication hole;

a nozzle plate containing multiple nozzles communicating with the multiple individual liquid chambers to eject the liquid;

a filter disposed within a passageway between the common liquid chamber and the multiple individual liquid chambers to remove foreign substances from the liquid;

a through-hole provided adjacent to the filter and sealed by a frame member in which the common liquid chamber is formed, and a deformable vibration plate to compress the liquid supplied to the multiple individual liquid chambers, wherein both the filter and the through-hole are disposed in the vibration plate, the through-hole penetrates the member that forms a wall of the individual liquid chambers, an opening of the through-hole is sealed by a wall of the frame member.

* * * * *